US007498505B2

(12) United States Patent
Bando et al.

(10) Patent No.: US 7,498,505 B2
(45) Date of Patent: Mar. 3, 2009

(54) STORAGE MEDIUM STORING BREATH BLOWING DETERMINING PROGRAM, BREATH BLOWING DETERMINING APPARATUS, BREATH BLOWING DETERMINING METHOD, STORAGE MEDIUM STORING GAME PROGRAM, GAME APPARATUS, AND GAME CONTROL METHOD

(75) Inventors: Taro Bando, Kyoto (JP); Daiki Iwamoto, Kyoto (JP); Koichi Kawamoto, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 273 days.

(21) Appl. No.: 11/281,730

(22) Filed: Nov. 18, 2005

(65) Prior Publication Data

US 2006/0107824 A1 May 25, 2006

(30) Foreign Application Priority Data

Nov. 19, 2004 (JP) ..... 2004-336036

(51) Int. Cl.
*G10H 7/00* (2006.01)

(52) U.S. Cl. ..... 84/616; 84/622; 84/654; 84/659; 84/723; 84/730; 84/732; 84/735

(58) Field of Classification Search ..... None
See application file for complete search history.

(56) References Cited

U.S. PATENT DOCUMENTS

| | | | | |
|---|---|---|---|---|
| 5,245,130 | A * | 9/1993 | Wheaton | 84/742 |
| 5,459,280 | A * | 10/1995 | Masuda et al. | 84/622 |
| 2006/0027074 | A1 * | 2/2006 | Masuda et al. | 84/454 |

FOREIGN PATENT DOCUMENTS

| | | |
|---|---|---|
| JP | 11-143484 | 5/1999 |

* cited by examiner

*Primary Examiner*—Marlon T Fletcher
(74) *Attorney, Agent, or Firm*—Nixon & Vanderhye P.C.

(57) ABSTRACT

A game apparatus includes an operating switch and a microphone. A player operates a player object through intuition by the operating switch or inputting a sound. The number of zero crossings contained in waveform of a sound input through the microphone is detected, and also individual interval times between the zero crossings are detected. Then, it is determined whether or not the distribution of the interval times, i.e. the frequency distribution matches the distribution of interval times (frequency distribution) related to a breath sound stored in advance. If there is a match between the two, the input sound is recognized as a breath sound, and a game process based on the breath (wind) is carried out. For example, a game screen depicting the breath or wind is displayed on an LCD.

18 Claims, 12 Drawing Sheets

FIG. 6

REFERENCE DATA 482c

| AREA | f | DISTRIBUTION OF INTERVAL TIMES t | | | |
|---|---|---|---|---|---|
| | | GROUP A (t=2-25) | GROUP B (t=26-50) | GROUP C (t=51-75) | GROUP D (t=76 OR MORE) |
| 1 | 98-199 | $1<x_A<15$ | $1<x_B<13$ | $0\leqq x_C<9$ | $0\leqq x_D<6$ |
| 2 | 200-299 | $2<x_A<40$ | $1<x_B<19$ | $0\leqq x_C<9$ | $0\leqq x_D<6$ |
| 3 | 300-399 | $2<x_A<50$ | $1<x_B<19$ | $0\leqq x_C<8$ | $0\leqq x_D<6$ |
| 4 | 400-499 | $10<x_A<90$ | $1<x_B<19$ | $0\leqq x_C<8$ | $0\leqq x_D<6$ |
| 5 | 500-599 | $40<x_A<100$ | $1<x_B<15$ | $0\leqq x_C<5$ | $0\leqq x_D<2$ |
| 6 | 600-699 | $65<x_A<110$ | $1<x_B<15$ | $0\leqq x_C<2$ | $0\leqq x_D<2$ |
| 7 | 700-799 | $65<x_A<130$ | $1<x_B<15$ | $0\leqq x_C<2$ | $x_D=0$ |
| 8 | 800-899 | $75<x_A<150$ | $1<x_B<10$ | $0\leqq x_C<2$ | $x_D=0$ |
| 9 | 900-1099 | $90<x_A<199$ | $0\leqq x_B<8$ | $0\leqq x_C<2$ | $x_D=0$ |
| 10 | 1100-1299 | $120<x_A<199$ | $0\leqq x_B<3$ | $x_C=0$ | $x_D=0$ |
| 11 | 1300-1499 | $150<x_A<199$ | $0\leqq x_B<3$ | $x_C=0$ | $x_D=0$ |
| 12 | 1500-1883 | $x_A>199$ | $0\leqq x_B<3$ | $x_C=0$ | $x_D=0$ |
| 13 | 1884 OR MORE | $x_A>200$ | $x_B=0$ | $x_C=0$ | $x_D=0$ |

STORAGE MEDIUM STORING BREATH BLOWING DETERMINING PROGRAM, BREATH BLOWING DETERMINING APPARATUS, BREATH BLOWING DETERMINING METHOD, STORAGE MEDIUM STORING GAME PROGRAM, GAME APPARATUS, AND GAME CONTROL METHOD

CROSS REFERENCE OF RELATED APPLICATION

The disclosure of Japanese Patent Application No. 2004-336036 is incorporated herein by reference.

BACKGROUND

1. Field of the Technology

The present technology relates to a storage medium storing a breath blowing determining program, breath blowing determining apparatus, breath blowing determining method, storage medium storing a game program, game apparatus, and game control method. More specifically, the present technology relates to a storage medium storing a breath blowing determination program, breath blowing determining apparatus, breath blowing determining method, storage medium storing a game program, game apparatus, and game control method, which make it possible to determine whether or not a sound input from outside is detected by a breath.

2. Description of the Prior Art

One example of conventional breath blowing determining apparatus is disclosed in Japanese Patent Laying-open No. 11-143484 [G10L 3/00] laid-open on May 28, 1999. According to this prior art, sound elements forming breath sounds are stored in advance in a memory or the like. By a comparison between sound elements of a sound input from a microphone and sound elements stored in the memory, it is determined whether or not the input sound is a sound of breathing in/out.

However, this prior art poses a problem with an increase in memory capacity because sound elements forming breath sounds need to be stored beforehand in the memory or the like. In general, the waveform pattern of a breath sound changes according to the body size of the user who is breathing out, the breathing strength, etc. That is, in order to raise the success rate of recognition of breath sounds by such a method as the prior art, various patterns of sound elements need to be stored in the memory. On the other hand, if the number of sound elements stored in the memory are decreased for a reduction of the memory capacity, it becomes impossible to recognize various breath sounds of different waveform patterns with high accuracy, which will lead to a drop in success rate of recognition.

In addition, conceivable as an alternative way for breath recognition is a method using fast Fourier transform (FFT). This method allows the frequency band distribution (spectrum) to be determined with a fair degree of precision. Thus, by storing some spectrums of breaths beforehand in a memory, etc., it is possible to compare a spectrum of an input sound with them and determine whether or not the input sound results from breath blowing. However, this method would require complicated calculations and thus increase the load of performing calculating processes.

SUMMARY

Therefore, it is a primary feature of the present invention to provide a novel storage medium storing a breath blowing determining program, breath blowing determining apparatus, breath blowing determining method, storage medium storing a game program, game apparatus, and game control method.

It is another feature of the present invention to provide a storage medium storing a breath blowing determining program, a breath blowing determining apparatus, a breath blowing determining method, a storage medium storing a game program, a game apparatus, and a game control method, which make it possible to recognize breath blowing with high accuracy and even lighten a processing load.

The storage medium storing a breath blowing determining program according to an exemplary embodiment presented herein stores a breath blowing determining program for the breath blowing determining apparatus. The breath blowing determining apparatus is equipped with at least a microphone and determines whether or not a sound input from outside through this microphone is made by a breath. The breath blowing determining program causes a processor of the breath blowing determining apparatus to perform an input sound detecting step, a time measuring step, and a sound determining step. In the input sound detecting step, a sound input from outside is detected at each unit of time. In the time measuring step, individual times between zero crossings in waveform data of the sound detected in the input sound detecting step are measured. In the sound determining step, it is determined whether or not the sound detected on the basis of the times measured in the time measuring step is made by the operator's breath.

More specifically, the breath blowing determining program is performed by the processor of the breath blowing determining apparatus (10). The breath blowing determining apparatus is equipped with at least the microphone (34) and determines whether or not a sound input from outside is made by a breath. To be more specific, the breath blowing determining program causes the processor (42) of the breath blowing determining apparatus to perform the input sound detecting step (S31, S61), the time measuring step (S37, S67), and the sound determining step (S39, S41, S43, S71). In the input sound detecting step, a sound input from outside is detected at each unit of time. In the time measuring step, individual times between zero crossings in waveform data of the sound detected in the input sound detecting step are measured. In the sound determining step, it is determined whether or not the sound detected on the basis of the individual times measured in the time measuring step is made by the operator's breath.

According to the exemplary embodiment, it is determined whether the input sound is a breath sound or not based on the times between zero crossings that are a characteristic common to sound waveforms. This makes it possible to recognize breath blowing correctly with a small processing load.

In one aspect of the exemplary embodiment, the sound determining step includes a frequency distribution detecting step of detecting a frequency distribution of the waveform data based on the individual times measured in the time measuring step, and a frequency distribution determining step of determining whether or not the frequency distribution detected in the frequency distribution detecting step satisfies a preset requirement. More specifically, the sound determining step includes the frequency distribution detecting step (S39) and the frequency distribution determining step (S41). In the frequency distribution detecting step, the frequency distribution of the waveform data is detected on the basis of the individual times measured in the time measuring step. In the frequency distribution determining step, it is determined whether or not the frequency distribution detected in the frequency distribution detecting step satisfies a preset requirement. In this manner, it is possible to recognize a breath sound accurately with a relatively small number of processes, just detecting the frequency distribution of waveform data, i.e. input sound, on the basis of the times between zero crossings and determining whether or not the frequency distribution satisfies a preset requirement.

In one embodiment the frequency distribution detecting step includes a time length classifying step of classifying lengths of the individual times into a plurality of groups. In the frequency distribution determining step, it is determined whether or not the numbers of the time lengths classified into the plurality of groups fall within respective ranges preset for the groups. In the sound determining step, when it is determined in the frequency distribution determining step that the numbers of the time lengths classified into the plurality of groups fall within the respective ranges preset for the groups, it is concluded that the detected sound is made by a breath. More specifically, the frequency distribution detecting step includes the time length classifying step of classifying the lengths of the individual times into a plurality of groups. In the frequency distribution determining step, it is determined whether or not the numbers of the time lengths classified into the plurality of groups fall within the respective ranges (or preset values in some cases) preset for the groups. That is, it is determined whether or not the numbers of the time lengths satisfy preset requirements. In the sound determining step, when it is determined in the frequency distribution determining step that the numbers of the time lengths classified into the plurality of groups fall within the ranges preset for the respective groups, that is, when the preset requirement is satisfied, it is concluded that the detected sound is made by a breath. Consequently, the input sound is determined as a breath sound when the numbers of the time lengths classified into the plurality of groups fall within the respective ranges preset for the groups, which makes it possible to recognize a breath sound with high accuracy.

In another aspect of the exemplary embodiment presented herein, further performed is a ratio detecting step of detecting the ratio of maximum value to minimum value of time lengths of the individual times. When the ratio detected in the ratio detecting step is equal to or more than a first predetermined value and the maximum value is equal to or more than a second predetermined value, it is concluded in the sound determining step that the input sound is made by a breath. More specifically, further performed is the ratio detecting step (S69) of detecting the ratio of maximum value to minimum value of time lengths of the individual times (maximum value/minimum value). When the ratio detected in the ratio detecting step is equal to or more than the first predetermined value and the maximum value are equal to or more than the second predetermined value, that is, when the preset requirement is satisfied, it is concluded in the sound determining step that the input sound is made by a breath. For example, the first predetermined value and the second predetermined value are values empirically obtained. In this manner, it is possible to recognize a breath sound correctly with a small processing load.

A breath blowing determining apparatus according to the exemplary embodiment comprises at least a microphone and determines whether or not a sound input from outside through this microphone is made by a breath. The breath blowing determining apparatus comprises an input sound detecting means, a time measuring means, and a sound determining means. The input sound detecting means detects a sound input from outside at each unit of time. The time measuring means measures individual times between zero crossings in waveform data of the sound detected by the input sound detecting means. The sound determining step determines whether or not the sound detected on the basis of the individual times measured by the time measuring means is made by the operator's breath.

The exemplary embodiment of breath blowing determining apparatus also makes it possible to recognize a breath sound correctly with a small processing load, as in the case of the above described present invention of storage apparatus storing a breath blowing determining program.

A breath blowing determining method according to the exemplary embodiment is a breath blowing determining method for a breath blowing determining apparatus that comprises at least a microphone and determines whether or not a sound from outside through this microphone is made by a breath. The breath blowing determining method includes (a) detecting a sound input from outside at each unit of time, (b) measuring individual times between zero crossings in waveform data of the sound detected in the step (a), and (c) determining whether or not the sound detected on the basis of the individual time measured in the time measuring step is caused by the operator's breath.

The exemplary embodiment of breath blowing determining method also makes it possible to recognize a breath sound correctly with a small processing load, as in the case of the above described present invention of storage apparatus storing a breath blowing determining program.

A storage medium storing a game program according to the exemplary embodiment stores a game program for a game apparatus. The game apparatus carries out a game process based on a sound input from outside. The game program allows a processor of the game apparatus to perform an input sound detecting step, a time measuring step, a sound determining step, and a game processing step. In the input sound detecting step, a sound input from outside is detected at each unit of time. In the time measuring step, individual times between zero crossings in waveform data of the sound detected in the input sound detecting step are measured. In the sound determining step, it is determined whether or not the sound detected on the basis of the individual times measured in the time measuring step is made by the operator's breath. In the game processing step, when it is determined in the sound determining step that the input sound is made by the breath, the game process is carried out in accordance with the breath.

More specifically, the game program is performed by the processor of the game apparatus (10). The game apparatus carries out a game process based on a sound input from outside. To be more specific, the game program allows the processor (42) of the game apparatus to perform the input sound detecting step (S31, S61), the time measuring step (S37, S67), the sound determining step (S39, S41, S43, S71), and the game processing step (S11). In the input sound detecting step, a sound input from outside is detected at each unit of time. In the time measuring step, individual times between zero crossings in the waveform data of the sound detected in the input sound detecting step are measured. In the sound determining step, it is determined whether or not the sound detected on the basis of the individual times measured in the time measuring step is made by the operator's breath. In the game processing step, when it is determined in the sound determining step that the input sound is made by the breath, the game process is carried out in accordance with the breath. For example, a player object performs the action of blowing a breath, or a wind is generated by the player object's action.

According to the exemplary embodiment, it is possible to recognize breath blowing correctly with a small operating load, as in the case of the above mentioned present invention of breath blowing determining program.

In one aspect of the exemplary embodiment, the sound determining step includes a frequency distribution detecting step of detecting a frequency distribution of waveform data based on the individual times measured in the time measuring step, and a frequency distribution determining step of determining whether or not the frequency distribution detected in the frequency distribution detecting step satisfies a preset requirement.

The exemplary embodiment of storage medium storing a game program also makes it possible to recognize a breath sound correctly with a small processing load, as in the case of the above described present invention of storage apparatus storing a breath blowing determining program.

In one embodiment the frequency distribution detecting step includes the time length classifying step of classifying the lengths of the individual times measured in the time measuring step into a plurality of groups. In the frequency distribution determining step, it is determined whether or not the numbers of the time lengths classified into the plurality of groups fall within the respective ranges preset for the groups. When it is determined in the frequency distribution determining step that the numbers of the time lengths classified into the plurality of groups fall within the ranges preset for the respective groups, it is concluded in the sound determining step that the detected sound is made by a breath.

The exemplary embodiment of storage medium storing a game program also makes it possible to recognize a breath sound correctly with high accuracy, as in the case of the above described present invention of storage apparatus storing a breath blowing determining program.

In another embodiment, further performed is a continuation state determining step of determining whether or not a state in which the numbers of the time strengths fall within the preset ranges for all the groups continues for a predetermined period of time or more. When it is determined in the continuation state determining step that the state has continued for the predetermined period of time or more, it is concluded in the sound determining step that the detected sound is made by the operator's breath. More specifically, in the continuation state determining step (S49), it is determined whether or not a state in which the numbers of the time strengths fall within the preset ranges for all the groups, that is, a state in which the sound is assumed to be a breath sound, continues for a predetermined period of time or more. When it is in the continuation state determining step determined that the state has continued for the predetermined period of time or more, it is concluded in the sound determining step that the detected sound is made by the operator's breath. In this manner, the input sound is concluded as a breath sound when the state in which the sound is assumed to be a breath sound has continued for the predetermined time or more, it is possible to recognize a breath sound with high accuracy.

In another aspect of the exemplary embodiment presented herein, further performed is a number-of-zero crossing counting step of counting the number of the zero crossings. When it is determined that the number of zero crossings falls within a preset range, it is concluded in the sound determining step that the detected sound is made by the operator's breath. More specifically, in the number-of-zero crossing counting step (S33, S63), the number of zero crossings is counted. When it is determined that the number of the zero crossings falls within the preset range ("YES" is S35, S65), it is concluded in the sound determining step that the detected sound is made by the operator's breath. That is, the input sound is concluded to be a breath sound when the number of zero crossings falls within the preset range, which makes it possible to recognize a breath sound with high accuracy.

In one embodiment, further performed is a strength setting step of setting the strength of a breath based on the number of zero crossings counted in the number-of-zero crossing counting step. In the game processing step, a game process is performed according to the breath strength set in the strength setting step. More specifically, in the strength setting step (S17, S53, S81), the strength of a breath or wind is set on the basis of the number of zero crossings counted in the number-of-zero crossing counting step. In the game processing step, a game process is performed according to the breath strength set in the strength setting step. That is, since the breath strength varies in accordance with the number of zero crossings, it is possible to detect the breath strength with ease.

In another embodiment, in the game processing step, a game process is carried out in such a manner as to make a change to the range affected by a breath or wind in the game space, according to the breath strength set in the strength setting step. More specifically, in the game processing step, a game process is carried out in such a manner as to make a change to the range (distance) affected by a breath or wind in the game space, according to the breath strength. Furthermore, a game process may be carried out in such a manner as to make a change to the influence exerted by a breath or wind. As stated above, it is possible to change the effect of a breath or wind, which makes the game more interesting.

According to still another aspect of the exemplary embodiment, in the game processing step, a game process is carried out in such a manner that a character of the game performs the action of blowing a breath. More specifically, in the game processing step, a game process is carried out in such a manner that the character (102) of the game performs the action of blowing a breath. For example, it is possible to display a breath object (104) so as to come out from the mouth of the character, and display an object (106) under the effect of the breath or wind. Accordingly, the operator can operate the game by intuition.

In further another aspect of the exemplary embodiment, a zero crossing is a boundary point at which the amplitude value of waveform data changes from minus to plus levels or from plus to minus levels. More specifically, the zero crossing is a boundary point at which the amplitude value of the waveform data changes from minus to plus levels or from plus to minus levels. That is, the number of zero crossings to be detected is decreased, which would thus lead to a reduction in the processing load.

In another aspect of then exemplary embodiment, further performed is a ratio detecting step of detecting the ratio of maximum value to minimum value of time lengths of the individual times. When the ratio detected in the ratio detecting step is equal to or more than a first predetermined value and the maximum value is equal to or more than a second predetermined value, it is concluded in the sound determining step that the input sound is made by the operator's breath. More specifically, further performed is the ratio detecting step (S69) of detecting the ratio of maximum value to minimum value of time lengths of the individual times (maximum value/minimum value). When the ratio detected in the ratio detecting step is equal to or more than the first predetermined value and the maximum value is equal to or more than the second predetermined value, that is, when the preset requirement is satisfied, it is concluded in the sound determining step that the input sound is made by the breath. For example, the first predetermined value and the second predetermined value are values empirically obtained. In this manner, it is possible to recognize a breath sound correctly with a small processing load.

A game apparatus according to the exemplary embodiment presented herein carries out a game process based on a sound input from outside. The game apparatus comprises an input sound detecting means, a time measuring means, a sound determining means, and a game processing means. The input sound detecting means detects a sound input from outside at each unit of time. The time measuring means measures individual times between zero crossings in waveform data of the sound detected by the input sound detecting means. The sound determining means determines whether or not the sound detected on the basis of the times measured by the time measuring means is made by the operator's breath. When the sound determining means has determined that the input sound is made by the breath, the game processing means carries out a game process based on the breath.

The exemplary embodiment presented herein of game apparatus also makes it possible to recognize a breath sound correctly with a small processing load, as in the case of the above described present invention of storage medium storing a game program.

A game control method according to the exemplary embodiment is for carrying out a game process based on a sound from outside. The game control method includes (a) detecting a sound input from outside at each unit of time, (b) measuring individual times between zero crossings in a waveform of the sound detected in the step (a), (c) determining whether or not the sound detected on the basis of the individual times measured in the step (b) is made by the operator's breath, and (d) when it is determined in the step (c) that the detected sound is made by the breath, performing a game process based on the breath.

The exemplary embodiment presented herein of game apparatus also makes it possible to recognize a breath sound correctly with a small processing load, as in the case of the above described present invention of storage medium storing a game program.

The above described features, aspects and advantages of the exemplary embodiment presented herein will become more apparent from the following detailed description of the present invention when taken in conjunction with the accompanying drawings.

BRIEF DESCRIPTION OF THE DRAWINGS

FIG. 6 is an illustrative view showing detailed contents of reference data used for a breath blowing determining process;

DETAILED DESCRIPTION OF THE PREFERRED EMBODIMENTS

First Embodiment

Figure 1:
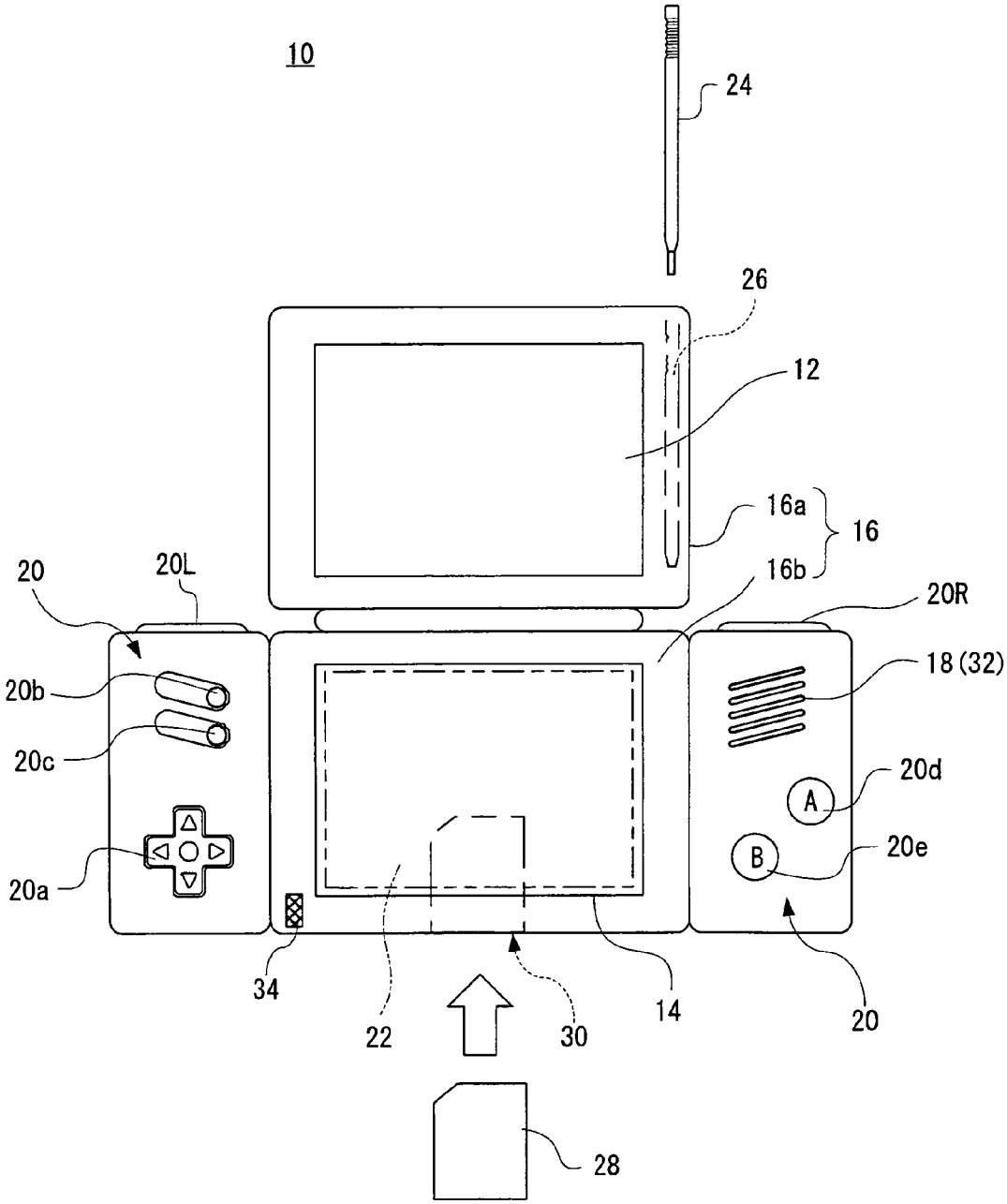
FIG. 1 is an illustrative view showing one example of game apparatus of an exemplary embodiment.

Referring to FIG. 1, the game apparatus 10, the first embodiment of the present invention, includes a first liquid crystal display (LCD) and a second LCD 14. The LCD 12 and LCD 14 are stored in a housing 16 in such a manner as to be arranged in predetermined positions. For example, the housing 16 is composed of an upper housing 16*a* and a lower housing 16*b*, the LCD 12 is stored in the upper housing 16*a*, and the LCD 14 is stored in the lower housing 16*b*. Therefore, the LCD 12 and LCD 14 are vertically (longitudinally) arranged close to each other.

In the first embodiment, LCDs are employed as display. Instead of the LCDs, EL (Electronic Luminescence) displays and plasma displays may be utilized.

The game apparatus 10 also stores a breath blowing determining program (see FIG. 7) and functions as a breath blowing apparatus, as described later.

As can be understood from FIG. 1, the upper housing 16*a* has a plane shape little larger than a plane shape of the LCD 12, and has an opening formed so as to expose a display surface of the LCD 12 from one main surface thereof. On the other hand, the lower housing 16*b* has a plane shape horizontally longer than the upper housing 16*a*, and has an opening formed so as to expose a display surface of the LCD 14 at an approximately center of the horizontal direction. Furthermore, the lower housing 16*b* is provided with a sound hole 18 and an operating switch 20 (20*a*, 20*b*, 20*c*, 20*d*, 20*e*, 20L and 20R).

In addition, the upper housing 16*a* and the lower housing 16*b* are rotatably connected at a lower side (lower edge) of the upper housing 16*a* and a part of an upper side (upper edge) of the lower housing 16*b*. Accordingly, in a case of not playing a game, for example, if the upper housing 16*a* is rotatably folded such that the display surface of the LCD 12 and the display surface of the LCD 14 are face to face with each other, it is possible to prevent the display surface of the LCD 12 and the display surface of the LCD 14 from being damaged such as a flaw, etc. It is noted that the upper housing 16*a* and the lower housing 16*b* are not necessarily rotatably connected with each other, and may alternatively be provided integrally (fixedly) to form the housing 16.

The operating switch 20 includes a direction instructing switch (cross switch) 20*a*, a start switch 20*b*, a select switch 20*c*, an action switch (A button) 20*d*, an action switch (B button) 20*e*, an action switch (L button) 20L, and an action switch (R button) 20R. The switches 20*a*, 20*b* and 20*c* are placed at the left of the LCD 14 on the one main surface of the lower housing 16*b*. Also, the switches 20*d* and 20*e* are placed at the right of the LCD 14 on the one main surface of the lower housing 16*b*. Furthermore, the switches 20L and 20R are placed in a part of an upper edge (top surface) of the lower housing 16*b* at a place except for a connected portion, and lie of each side of the connected portion with the upper housing 16*a*.

The direction instructing switch 20*a* functions as a digital joystick, and is utilized for instructing a moving direction of a player character (or player object) to be operated by an operator (player), instructing a moving direction of a cursor, and so forth by operating any one of four depression portions. The start switch 20*b* is formed by a push button, and is utilized for starting (restarting), temporarily stopping (pausing) a game, and so forth. The select switch 20*c* is formed by the push button, and utilized for a game mode selection, etc.

The action switch 20*d*, that is, the A button is formed by the push button, and allows the player character to perform an arbitrary action, except for instructing the direction, such as hitting (punching), throwing, holding (obtaining), riding, jumping, etc. For example, in an action game, it is possible to apply an instruction of jumping, punching, moving arms, etc. In a role-playing game (RPG) and a simulation RPG, it is possible to apply an instruction of obtaining an item, selecting and determining arms or command, etc. The action switch 20*e*, that is, the B button is formed by the push button, and is utilized for changing a game mode selected by the select switch 20*c*, canceling an action determined by the A button 20*d*, and so forth.

The action switch (L button) 20L and the action switch (R button) 20R are formed by the push button, and the L button 20L and the R button 20R can perform the same operation as the A button 20*d* and the B button 20*e*, and also function as a subsidiary of the A button 20*d* and the B button 20*e*.

Also, on a top surface of the LCD 14, a touch panel 22 is provided. As the touch panel 22, any one of kinds of a resistance film system, an optical system (infrared rays system) and an electrostatic capacitive coupling system, for example, can be utilized. In response to an operation of depressing, stroking or touching with a stick 24, a pen (stylus pen), or a finger (hereinafter, referred to as "stick 24, etc.") on a top surface (detection surface) of the touch panel 22, the touch panel 22 detects coordinates (touch coordinate) of position of operation (touch input) by means of the stick 24, etc. and outputs coordinate data corresponding to the detected touch coordinates.

For example, a resolution of the display surface of the LCD 14 is 256 dots×192 dots, and a detection accuracy of a detection surface of the touch panel 22 is also rendered 256 dots×192 dots in correspondence to the resolution of the display surface (this is the same or approximately the same as for the LCD 12). However, detection accuracy of the detection surface of the touch panel 22 may be lower than the resolution of the display surface of the LCD 14, or higher than it.

It is possible to display different game images (game screens) on the LCD 12 and the LCD 14. For example, in a racing game, a screen viewed from a driving seat is displayed on the one LCD, and a screen of entire race (course) may be displayed on the other LCD. Moreover, in a puzzle game, the entire puzzle (game map) may be displayed on one LCD (e.g. the LCD 12) and a part of the game map (a screen for operating the puzzle game) may be displayed on the other LCD (e.g. the LCD 14). In the screen displaying a part of the game map, for example, it is possible to draw an image of character, graphic or the like, and move a displayed image (icon), etc. Furthermore, by using the two LCD 12 and LCD 14 as one screen, it is possible to display a big monster (enemy character) to be defeated by the player character.

This allows the player to point at (specify) or make active (move) character images displayed on the LCD 14, such as player characters, enemy characters, item characters, text information and icons, or select a command, by operating the touch panel 22 with the stick 24, etc. Besides, this also makes it possible to change an orientation of a virtual camera (viewpoint) provided in the three-dimensional game space or scroll through a game screen (game map) (the screen is displayed in a state of being gradually moved).

As stated above, the game apparatus 10 has the LCD 12 and the LCD 14 as a display portion of two screens, and by providing the touch panel 22 on an upper surface of any one of them (LCD 14 in the first embodiment), the game apparatus 10 has the two screens (LCD 12, 14) and the two operating portions (20, 22).

Additionally, in the first embodiment, the stick 24 can be stored in a housing portion (housing slot) 26 provided in proximity to a side surface (right side surface) of the upper housing 16*a*, for example, and taken out therefrom as necessary. However, in a case of not preparing the stick 24, it is not necessary to provide the housing portion 26.

Also, the game apparatus 10 includes a memory card (or game cartridge) 28, and the memory card 28 is detachable, and inserted into a loading slot 30 provided on a rear surface or a lower edge (bottom surface) of the lower housing 16*b*. Although omitted in FIG. 1, a connector 46 (see FIG. 2) is provided at a depth portion of the loading slot 30 for connecting a connector (not shown) provided at an end portion of the memory card 28 in the loading direction, and when the memory card 28 is loaded into the loading slot 30, the connectors are connected with each other, and therefore, the memory card 28 is accessible by a CPU core 42 (see FIG. 2) of the game apparatus 10.

Furthermore, the game apparatus 10 includes a microphone 34. For example, the microphone 34 is provided in the lower left oblique part of the LCD 14 of the lower housing 16*b*. Therefore, when a sound (the voice of the player or user) is input from the microphone 34, the game apparatus 10 performs game processes according to this.

Although not illustrated in FIG. 1, a speaker 32 (see FIG. 2) is provided at a position corresponding to the sound hole 18 inside the lower housing 16*b*.

Furthermore, although omitted in FIG. 1, for example, a battery accommodating box is provided on a rear surface of the lower housing 16*b*, and a power switch, a volume switch, an external expansion connector, an earphone jack, etc. are provided on a bottom surface of the lower housing 16*b*.

Figure 2:
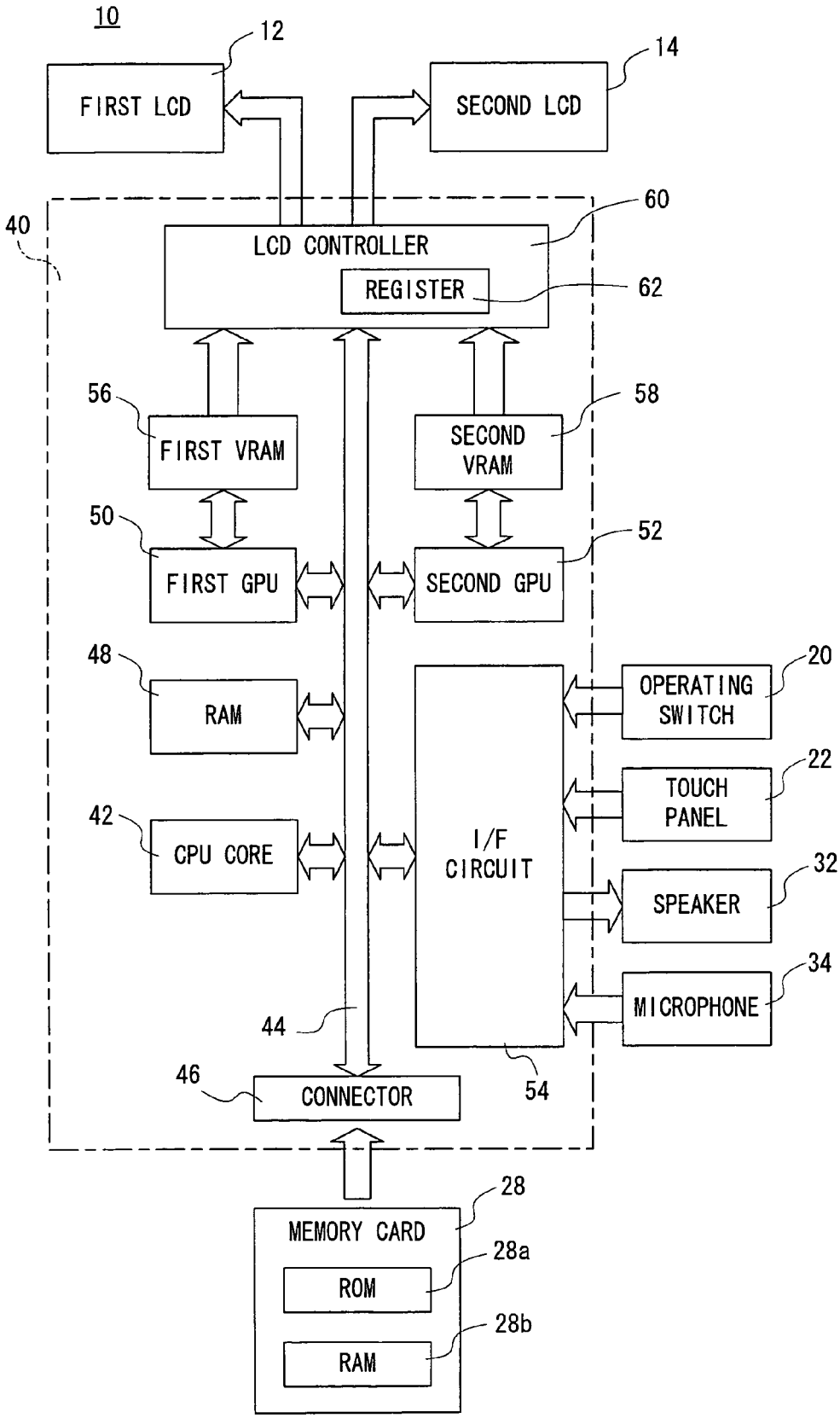
FIG. 2 is a block diagram showing electrical structure of the game apparatus shown in FIG. 1.

FIG. 2 is a block diagram showing an electric configuration of the game apparatus 10. Referring to FIG. 2, the game apparatus 10 includes an electronic circuit board 40, and on the electronic circuit board 40, a circuit component such as a CPU core 42, etc. is mounted. The CPU core 42 is connected to the connector 46 via a bus 44, and is connected with a RAM 48, a first graphics processing unit (GPU) 50, a second GPU 52, an input-output interface circuit (hereinafter, referred to as "I/F circuit") 54, and an LCD controller 60.

The connector 46 is detachably connected with the memory card 28 as described above. The memory card 28 includes a ROM 28*a* and a RAM 28*b*, and although illustration is omitted, the ROM 28*a* and the RAM 28*b* are connected with each other via a bus and also connected with a connector (not shown) to be connected with the connector 46. Accordingly, the CPU core 42 gains access to the ROM 28*a* and the RAM 28*b* as described above.

The ROM 28*a* stores in advance a game program for a virtual game (golf game in this embodiment) to be executed by the game apparatus 10, image (character image, background image, item image, icon (button) image, message image, etc.) data, data of the sound (music) necessary for the game (sound data), etc. The RAM (backup RAM) 28*b* stores (saves) proceeding data and result data of the game.

The RAM 48 is utilized as a buffer memory or a working memory. That is, the CPU core 42 loads the game program, the image data, the sound data, etc. stored in the ROM 28*a* of the memory card 28 into the RAM 48, and executes the loaded game program. The CPU core 42 executes a game process while storing in the RAM 48 data (game data and flag data) temporarily generated in correspondence with a progress of the game.

Besides, such the game program, the image data, the sound data, etc. are loaded from the ROM 28*a* entirely at a time, or partially and sequentially so as to be stored (loaded) into the RAM 48.

Each of the GPU 50 and the GPU 52 forms a part of a rendering means, is constructed by, for example, a single chip ASIC, and receives a graphics command (graphics command) from the CPU core 42 to generate game image data according to the graphics command. However, the CPU core 42 provides each of the GPU 50 and the GPU 52 with an image generating program (included in the game program) required for generation of the game image data in addition to the graphics command.

Furthermore, the GPU 50 is connected with a first video RAM (hereinafter, referred to as "VRAM") 56, and the GPU 52 is connected with a second VRAM 58. The GPU 50 and the GPU 52 obtain data required for the GPU 50 and the GPU 52 to execute the graphics command (image data: character data, texture data, etc.) by access to a first VRAM 56 and a second VRAM 58, respectively. Also, the CPU core 42 writes the image data required for graphics drawing into the first VRAM 56 and the second VRAM 58 via the GPU 50 and the GPU 52. The GPU 50 accesses the VRAM 56 to generate the game image data for graphics drawing, and the GPU 52 accesses the VRAM 58 to generate the game image data for graphics drawing.

The VRAM 56 and the VRAM 58 are connected to the LCD controller 60. The LCD controller 60 includes a register 62, and the register 62 consists of, for example, one bit, and stores a value of "0" or "1" (data value) according to an instruction of the CPU core 42. In a case that the data value of the register 62 is "0", the LCD controller 60 outputs the game image data generated by the GPU 50 to the LCD 12, and outputs the game image data generated by the GPU 52 to the LCD 14. Furthermore, in a case that the data value of the register 62 is "1", the LCD controller 60 outputs the game image data generated by the GPU 50 to the LCD 14, and outputs the game image data generated by the GPU 52 to the LCD 12.

Besides, the LCD controller 60 reads out game image data directly from the VRAM 56 and the VRAM 58, and reads out game image data from the VRAM 56 and the VRAM 58 via the GPU 50 and the GPU 52.

The I/F circuit 54 is connected with the operating switch 20, the touch panel 22, the speaker 32, and the microphone 34. Here, the operating switch 20 is the above-described switches 20*a*, 20*b*, 20*c*, 20*d*, 20*e*, 20L and 20R, and in response to an operation of the operating switch 20, a corresponding operation signal is converted into digital data (operation data) in the I/F circuit 54 and then input to the CPU core 42. Furthermore, the coordinate position data from the touch panel 22 is input to the CPU core 42 via the I/F circuit 54. In addition, the CPU core 42 reads the sound data necessary for the game such as a game music (BGM), a sound effect or voices of a game character (onomatopoeic sound), etc. from the RAM 48, and provides it to the I/F circuit 54. The I/F circuit 54 converts the sound data into an analog audio signal and output it from the speaker 32. In addition, the sound (audio signal) input from the microphone 34 is converted into digital data (audio data) in the I/F circuit 54 and then input to the CPU core 42.

Figure 3:
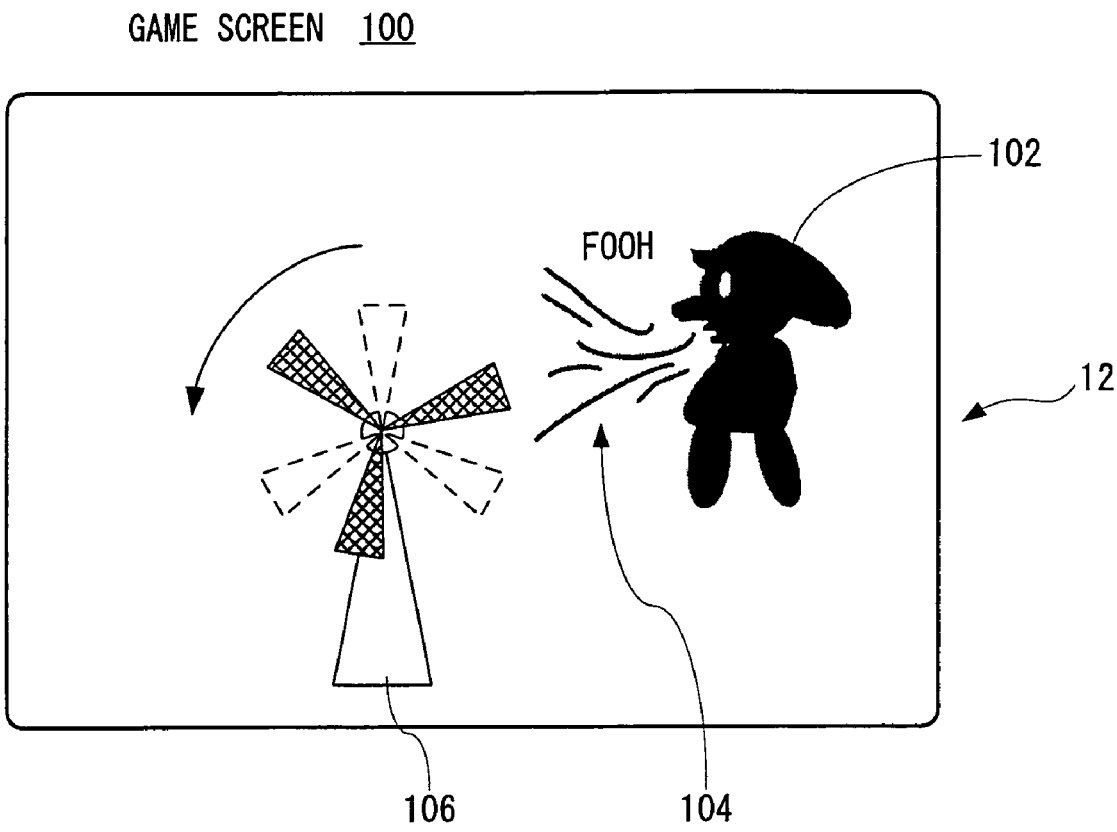
FIG. 3 is an illustrative view showing one example of game screen.

FIG. 3 is an illustrative view showing an example of a game screen 100 displayed on the LCD 12. The game screen 100 displays a player object 102, an object of breath (breath object) 104 blown by the player object 102, and a windmill object 106. The game screen 100 presents a situation in which the player object 102 blows a breath (the breath object 104) on the windmill object 106 and the windmill object 106 rotates accordingly.

Besides, as stated above, the first embodiment is provided with two screens (LCD 12 and LCD 14), and thus the game screen 100 may be displayed on the LCD 14. Also, the other screen not displaying the game screen 100 may display the contents related to game playing, that is, a game map, parameters for the player object (vital power, level, etc.), game progress status (the number of cleared phases, the amount of time passed in the game world), etc.

As mentioned above, the player can operate the operating switch 20 to move the player object 102 in the three-dimensional virtual space (game space) or make the player object 102 perform an arbitrary action such as giving a jump. In addition, for example, when the player blows a breath on the microphone 34, the sound (made by the breath) is input through the microphone 34, which causes the player object 102 to perform an action of blowing a breath.

In this manner, the player object 102 can be operated by a breath sound. However, it is impossible to accurately effect the action of the player object 102 unless it is determined with high accuracy whether the sound is made by a breath or not. In addition, if every sound is recognized as a breath sound, the game becomes out of touch with reality and thus it is impossible to achieve a realistic sense of operation.

For example, there is a method to determine whether the player has blown a breath or not by storing in advance waveform patterns of sound elements of breath blowing sounds (breath sounds) and comparing the sound elements of an input sound with the stored sound elements. Moreover, there is also a method for making a determination on whether the player has blown a breath or not by calculating a spectrum of an input sound through the fast Fourier transform (FFT) process and comparing the calculated spectrum with the spectrums of the breath sounds stored in advance.

In general, however, the waveform pattern of a breath sound varies according to the body size of the player who blows the breath or the strength of the blown breath. In the former case, in order to raise the success rate of recognition of breath sounds, it is necessary to store various patterns of sound elements in the memory. This will lead to an increase in memory capacity. If, for the purpose of avoiding this, the number of sound elements stored in the memory is decreased, it becomes impossible to recognize various breath sounds of different waveform patterns with high accuracy, which results in a drop in the success rate of recognition.

Additionally, in the later case, it is possible to recognize breath blowing correctly because the spectrum of the breath sound can be measured with considerable accuracy. However, this would require some complicated calculation processes and thus increase a processing load.

Accordingly, in order to avoid these troubles, it is determined in the first embodiment whether or not an input sound is a breath blowing sound, based on zero crossings of a sound waveform corresponding to an input sound.

Figure 4:
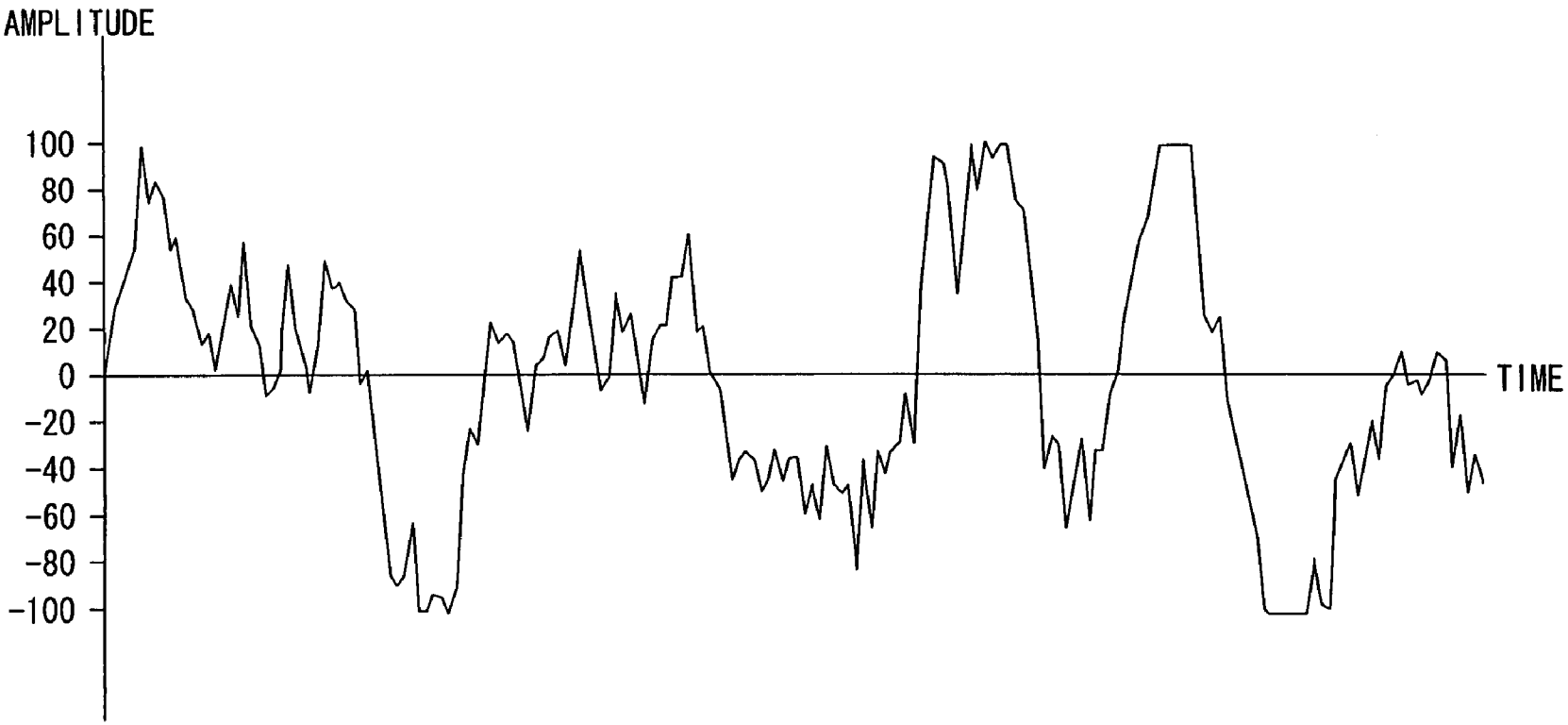
FIG. 4 is a graph showing some changes with time in sound waveform of a sound made by a breath input from a microphone.

For example, FIG. 4 shows one example of a waveform that takes place when a breath hits the microphone 34, i.e., a breath sound waveform. As is well known, a zero crossing is a point (boundary point) at which the amplitude of a waveform crosses the 0 level in the course of changing from plus to minus levels or from minus to plus levels. The determination of whether or not an input sound is a breath sound is based on an interval time t (msec) between zero crossings. Particularly noted in the first embodiment is a zero crossing that takes place when the amplitude of a sound waveform changes from minus to plus levels. Thus, the interval time t between zero crossings is a length of time defined by two consecutive zero crossings that occur when the amplitude of the waveform changes from minus to plus levels. That is, the cycle (frequency) of each wave contained in the sound waveform is to be calculated.

Alternatively, the interval time t between the detected zero crossings may be a length of time defined by two consecutive zero crossings that occur when the amplitude of the waveform changes from plus to minus levels.

Moreover, the unit of the interval time t is here "msec" for the sake of simplicity. In the strict sense, the sampling rate of the CPU core 42 is 1/8000 sec and the unit of the interval time t is also "1/8000 sec". This applies throughout this document.

Besides, noted in this embodiment is a zero crossing that takes place when the amplitude of a waveform changes from minus to plus levels or from plus to minus levels, for the purpose of cutting out excessive processes.

As stated above, it is determined in the first embodiment whether an input sound is a breath sound or not based on the interval time t between zero crossings. At that time, reference data 482*c* (stored in data storage area 482 of the RAM 48) is referred to as shown in FIG. 6. The reference data 482*c* is data obtained empirically from experiments, etc. An input sound is assumed as a breath sound if any of requirements contained in the reference data 482*c* is satisfied. Also, the input sound is determined (recognized) as a breath sound if that state continues for a predetermined amount of time (two consecutive frames in the first embodiment). In addition, when the input sound is determined as a breath sound, the strength of the breath (wind) is defined (decided) on the basis of the number of zero crossings.

As shown in FIG. 6, the reference data 482*c* is expressed by table data, the range of a numerical value f based on the number of zero crossings for eight frames is described in correspondence with the area number, and according to that, the distribution of the interval times t is described. That is, the frequency distribution of a breath sound is described in correspondence with the numerical value f. Here, "frame" denotes the unit time of updating a screen (game screen), and is set at 1/60 second, for example. The numbers described in the area section are identification information for identifying the range of the numerical value f. Shown in the numerical value f section is the range of a value obtained by multiplying by 8 the number of zero crossings (at a time of a change from minus to plus levels) during the past (most recent) eight frames stored in the buffer, i.e. the data storage area 482. The distribution of the interval times t is indicated by four groups A, B, C and D that are discriminated by the range of the interval time t. More specifically, the range of the interval time t in the group A is 2 to 25 ($2 \leqq t \leqq 25$), the range of the interval time t in the group B is 26 to 50 ($26 \leqq t \leqq 50$), the range of the interval time t in the group C is 51 to 75 ($51 \leqq t \leqq 75$), and the range of the interval time t is the group D is 76 or more ($t \geqq 76$). For each of the groups, the set range or set value of the number of applicable interval times t is described corresponding to the numerical value f. However, the set range or set value is a numerical range or numerical value (requirement) for examining the distribution of the interval times t between zero crossings contained in one frame of a sound waveform.

For example, the area 2 is selected if the numerical value f that is eight times of the number of zero crossings for eight frames of the input sound waveform is within a range of 200 to 299. Then, it is determined whether or not, in the input sound waveform, the distribution of the interval times t between zero crossings for the frame immediately preceding the current frame satisfies all the requirements of the group A, group B, group C and group D (here, $2<xA<40$, $1<xB<19$, $0 \leqq xC<9$, and $0 \leqq xD<6$) corresponding to the area 2. That is, it is determined whether or not there are matches among the frequency distributions. More specifically, the number of the interval times t contained in each of the groups is counted, and it is determined whether or not the count value in each of the groups ($x_A$, $x_B$, $x_C$ or $x_D$) is within the preset numerical value range. However, if numerical values are set instead of the numerical value ranges, it is determined whether the numerical values are satisfied or not. If the state in which these requirements are satisfied continues for two frames or more, the input sound is determined as a breath sound. At the time, the strength of the breath (wind) in the game is decided on the basis of the numerical value f. For example, the strength of the breath (wind) is indicated within a range of 1 to 255 (8-bit binary data: "00000001" to "11111111") and calculated on the basis of the numerical value f. More specifically, the strength S of the breath (wind) is calculated according to equation 1. Also, a distance (range) d covered by the effect of the breath is calculated according to equation 2.

$$S=(f/7)-13 \quad \text{[Equation 1]}$$

$$d=A \cdot S \quad \text{[Equation 2]}$$

where A denotes a proportionality constant preset by a game developer or programmer. Alternatively, the value of the proportionality constant A may change according to the game progress status, kind of a player character, parameters for the player character (level, life), etc.

As described above, the breath strength S and the affected distance d are calculated, and the game processes (an image update, etc.) are carried out according to these values. For example, as stated above, in rotating the windmill object 106, the number of rotations of the windmill object 106 can be changed by the breath strength S. Also, in this case, it is possible to decide whether or not to allow the breath or wind blown by the player object 102 to reach the windmill object 106, that is, whether or not to rotate the windmill object 106. Moreover, although not illustrated, in blowing off a plurality of candle lights by the breath of the player object 102, it is possible to change the number of candles to be blown off, in accordance with the breath strength S. Furthermore, in this case, it is also possible to decide whether or not the breath or wind caused by the player object 102 reaches the candle objects, that is, whether or not the candle objects can be blown off, in accordance with the distance d.

Figure 7:
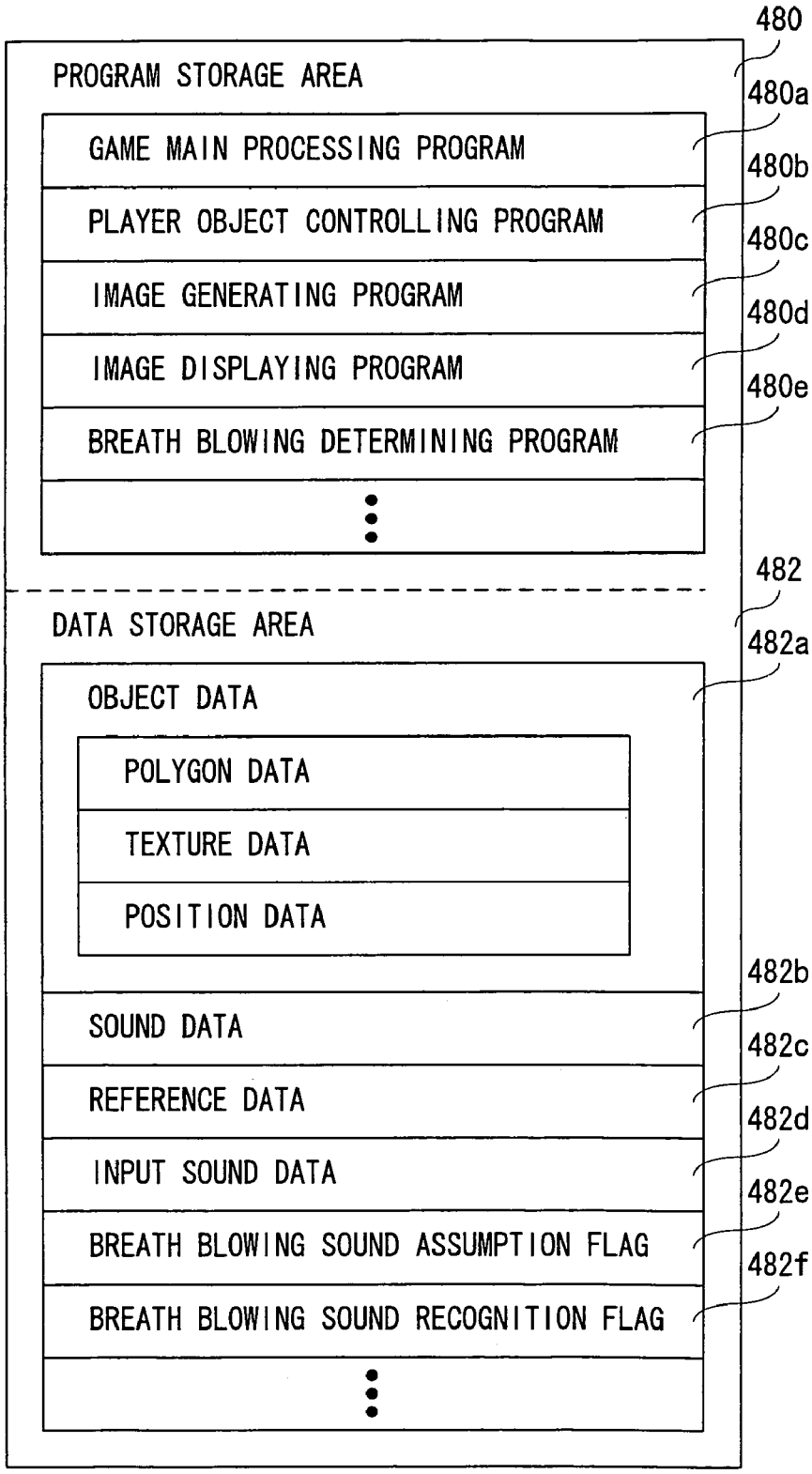
FIG. 7 is an illustrative view showing a memory map of a RAM contained in the game apparatus shown in FIG. 2.

FIG. 7 is an illustrative view showing a memory map of the RAM 48 shown in FIG. 2. Referring to FIG. 7, the RAM 48 includes a program storage area 480 and a data storage area 482. The program storage area 480 stores a game program that is composed of a game main processing program 480*a*, a player object controlling program 480*b*, an image generating program 480*c*, an image displaying program 480*d*, a breath blowing determining program 480*e*, etc.

The game main processing program 480*a* is a program for performing main processes for a virtual game. More specifically, this program makes a game progress, controls the action (movement), generation and extinction of non-player objects (the breath object 104 and the windmill object 106, for example), reproduces game music, and backs up game data. The player object controlling program 480*b* is a program that allows the player object 102 to perform an arbitrary action according to the player's operation. More specifically, as stated above, the action of the player character 102 is controlled according to the operational input by the operating switch 20 or voice (breath blowing sound).

The image generating program 480*c* is a program for generating object images of background object, player object 102 and non-player object (breath object 104, windmill object 106, etc.) in a virtual game, by the use of object data 482*a* described later. The image displaying program 480*d* is a program for displaying on the LCD 12 the object image generated according to the image generating program 480*c*. The breath blowing determining program 480*e* is a program for determining whether or not a sound input is done by breath blowing.

Besides, although not illustrated, the program storage area 480 also stores a sound reproducing program, backup program, etc. The sound reproducing program is a program for reproducing sounds (music) required for a virtual game. The backup program is a program for storing (saving) in-progress data generated with the progress of the game and result data, in the RAM 28*b* of the memory card 28.

The data storage area 482 stores object data 482*a*, sound data 482*b*, reference data 482*c*, input sound data 482*d*, etc., and is provided with a breath blowing sound assumption flag 482*e* and a breath blowing sound recognition flag 482*f*. The object data 482*a* is data used for generation of an object image, and includes image data such as polygon data and texture data and also includes data (position data) on the three-dimensional position (three-dimensional coordinates) of the object. Although not illustrated, the object data 482*a* is stored by object.

The sound data 482*b* is data required for reproducing sounds (music) for the game. The reference data 482*c* is table data as shown in FIG. 6, and used in the breath blowing determining process described later (see FIG. 9 and FIG. 10). The input sound data 482*d* is an audio signal (audio data) input through the microphone 34. Besides, in the first embodiment, the data storage area 482 records (temporarily stores) at least sound data of eight frames.

The breath blowing sound assumption flag 482*e* is a flag that is turned on (established) or off (not established) in the breath blowing determining process. The breath blowing sound assumption flag 482*e* is turned on if an input sound is assumed as a breath blowing sound, and turned off if the input sound is not assumed as a breath blowing sound. For example, the breath blowing sound assumption flag 482*e* is composed of a one-bit register. When the flag is turned on, the data value "1" is set to the register. In contrast, when the flag is turned off, the data value "0" is set to the register. The breath blowing sound recognition flag 482*f* is also a flag that is turned on or off in the breath blowing determining process. The breath blowing sound recognition flag 482*f* is turned on if an input sound is determined (recognized) as a breath blowing sound, and turned off if the input sound is not determined as a breath blowing sound. For example, the breath blowing sound recognition flag 482*f* is composed of a one-bit register. When the flag is turned on, the data value "1" is set to the register. In contrast, when the flag is turned off, the data value "0" is set to the register.

Besides, although not illustrated, the data storage area 482 also stores other data such as game data (in-progress data, result data) and other flags such as event flags.

Figure 8:
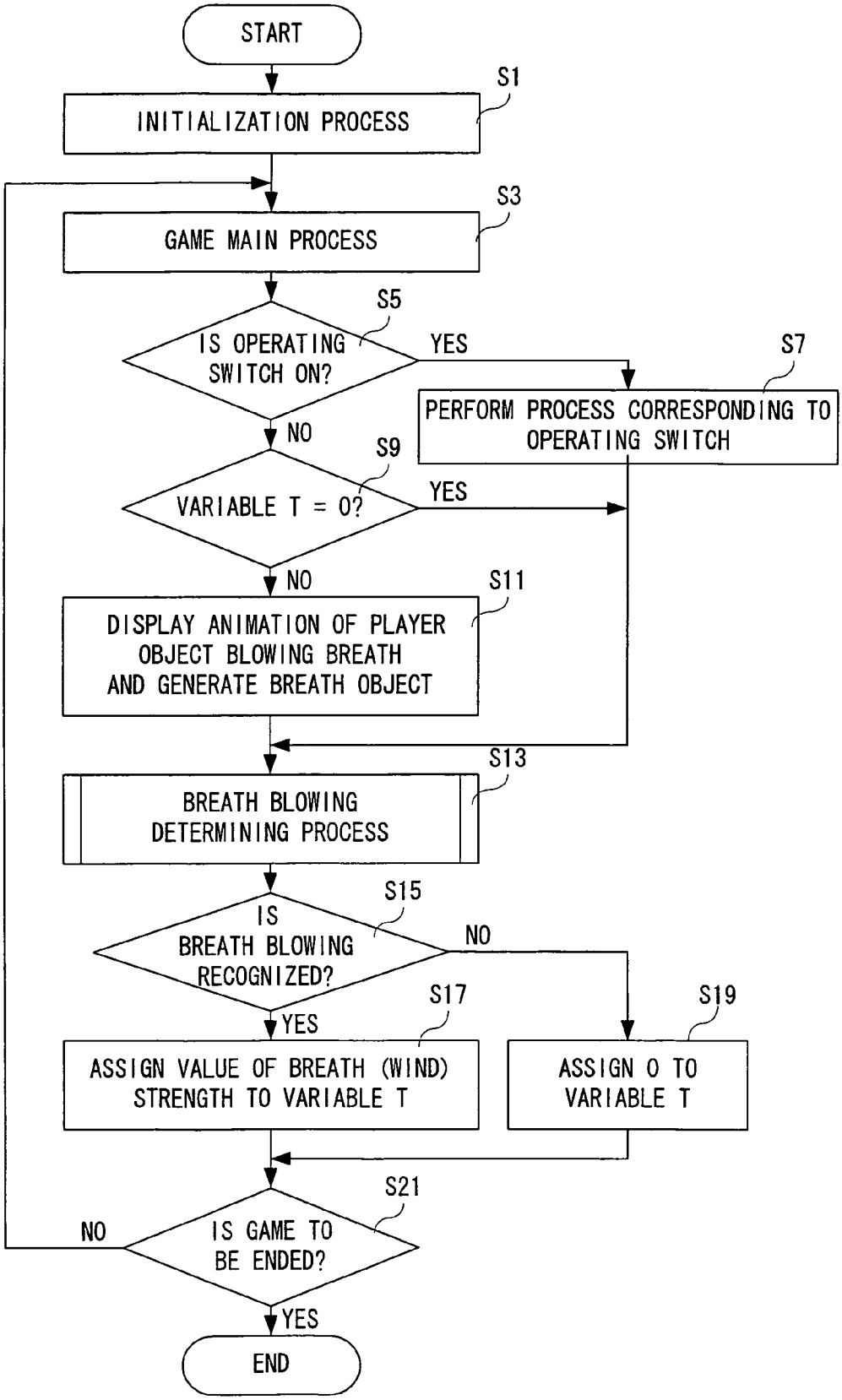
FIG. 8 is a flowchart showing game processes by the CPU core shown in FIG. 2.

FIG. 8 is a flowchart showing game processes by the CPU core 42 shown in FIG. 2. Referring to FIG. 8, when starting a game process, the CPU core 42 performs an initialization process in a step S1. Here, the CPU core 42 sets the arrangement positions (three-dimensional coordinates) of the player object 102 and non-player objects such as the windmill object 106 to initial positions, and clears the buffer, etc. However, in resuming the game from where it was stopped the previous time, the saved game data is read out from the RAM 28*b* of the memory card 28 and loaded into the RAM 48. In a succeeding step S3, a game main process is carried out. Performed here are image processing (animating process) on the objects other than the player object 102 (non-player objects and background objects), sound reproducing process, backup process, etc.

Subsequently, it is determined in a step S5 whether the operating switch 20 is turned on (operated) or not. If "YES" in the step S5, that is, if the operating switch 20 is operated, a process is carried out according to the operated operating switch 20 in a step S7, and then the process proceeds to a step S13. More specifically, in the step S7, the player object 102 is caused to perform an arbitrary action such as moving in the game space corresponding to the operated operating switch 20, and thus an animation indicative of that scene is displayed in the game screen 100. On the other hand, if "NO" in the step S5, that is, the operating switch 20 is off (not operated), it is determined in a step S9 whether or not a variable T is assigned with (set to) 0 (T=0). Here, the variable T is a variable for determining whether or not to make the player object 102 perform an action of blowing a breath, and the strength of the breath (wind) varies according to the value of the variable (1 to 255). However, if the variable T is assigned with 0, the player object 102 is not caused to blow a breath.

If "YES" in the step S9, that is, if the variable T is assigned with 0, the process moves directly to the step S13. On the other hand, if "NO" in the step S9, that is, the variable T is not assigned with 0, an animation of the player object 102 blowing a breath is displayed and the breath object is generated (displayed) in a step S11. Although not illustrated, different changes are made to the image according to the breath strength S and the distance d covered by the effect of the breath. The breath blowing determining process described in detail later (see FIG. 9 and FIG. 10) is carried out in the succeeding step S13, and it is determined in a step S15 whether the breath blowing is recognized or not. To be more specific, it is determined whether the breath blowing sound recognition flag 482*f* is turned on or not. If "YES" in the step S15, that is, if the breath blowing sound recognition flag 482*f* is on, it is concluded that the breath blowing is recognized, the variable T is assigned with the value of the breath (wind) strength S in a step S17, and the process moves to a step S21. However, if "NO" in the step S15, that is, if the breath blowing sound recognition flag 482*f* is off, it is concluded that the breath blowing is not recognized, the variable T is assigned with 0 in a step S19, and the process proceeds to the step S21.

In the step S21, it is determined whether the game is to be ended or not. That is, it is determined whether or not the end of the game is designated by the player or whether or not the game is over. If "NO" in the step S21, that is, if the game is not to be ended, the process returns directly to the step S3. However, if "YES" in the step S21, that is, the game process is to be ended, the game process is terminated.

Besides, the main process routine is repeatedly executed at each unit time (one frame, for example). Thus, the breath blowing determining process of step S13 (sound detection process) is carried out at each unit time.

Figure 9:
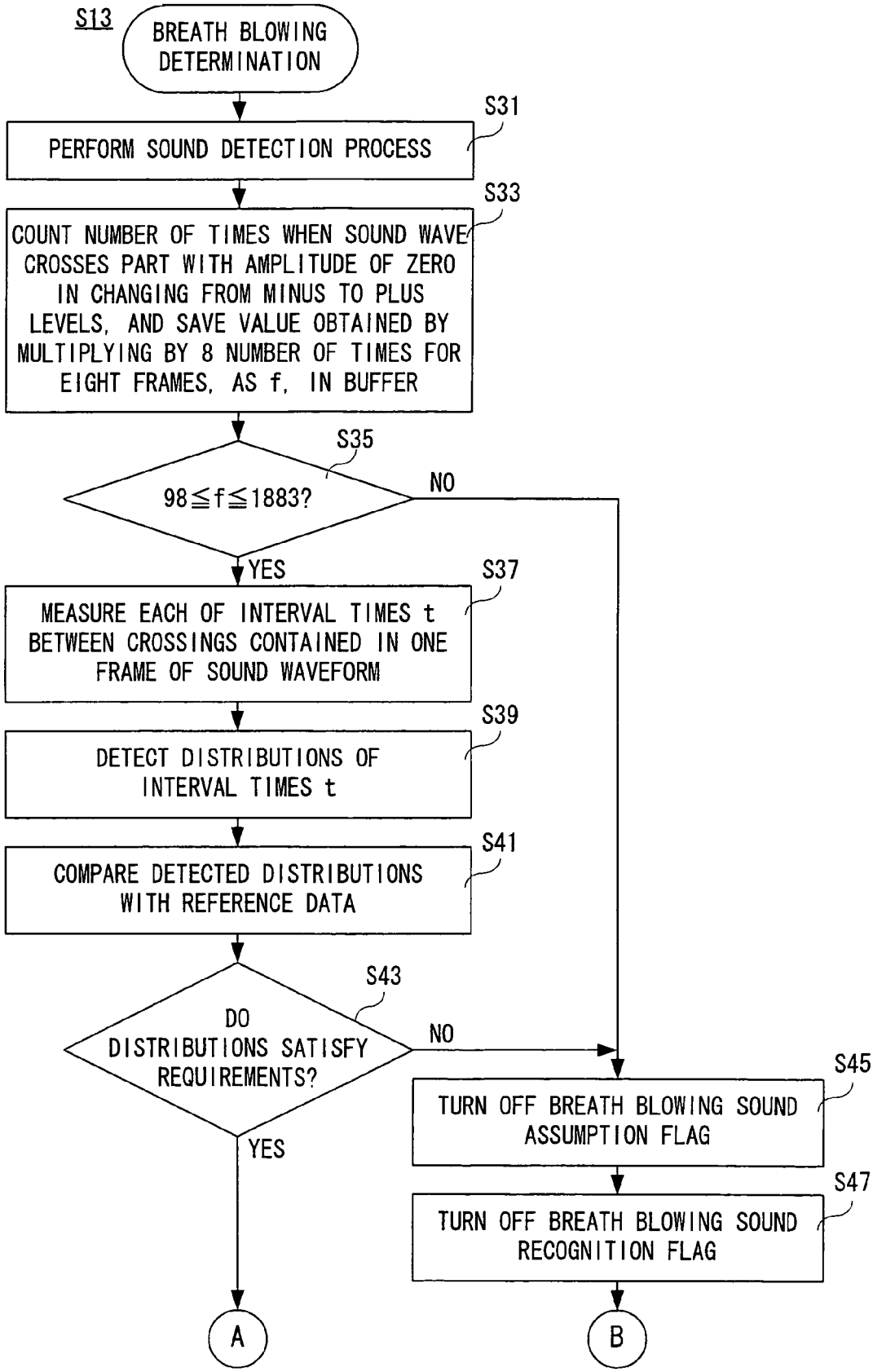
FIG. 9 is a flowchart showing a part of a breath blowing determining process by the CPU core shown in FIG. 2.
Figure 10:
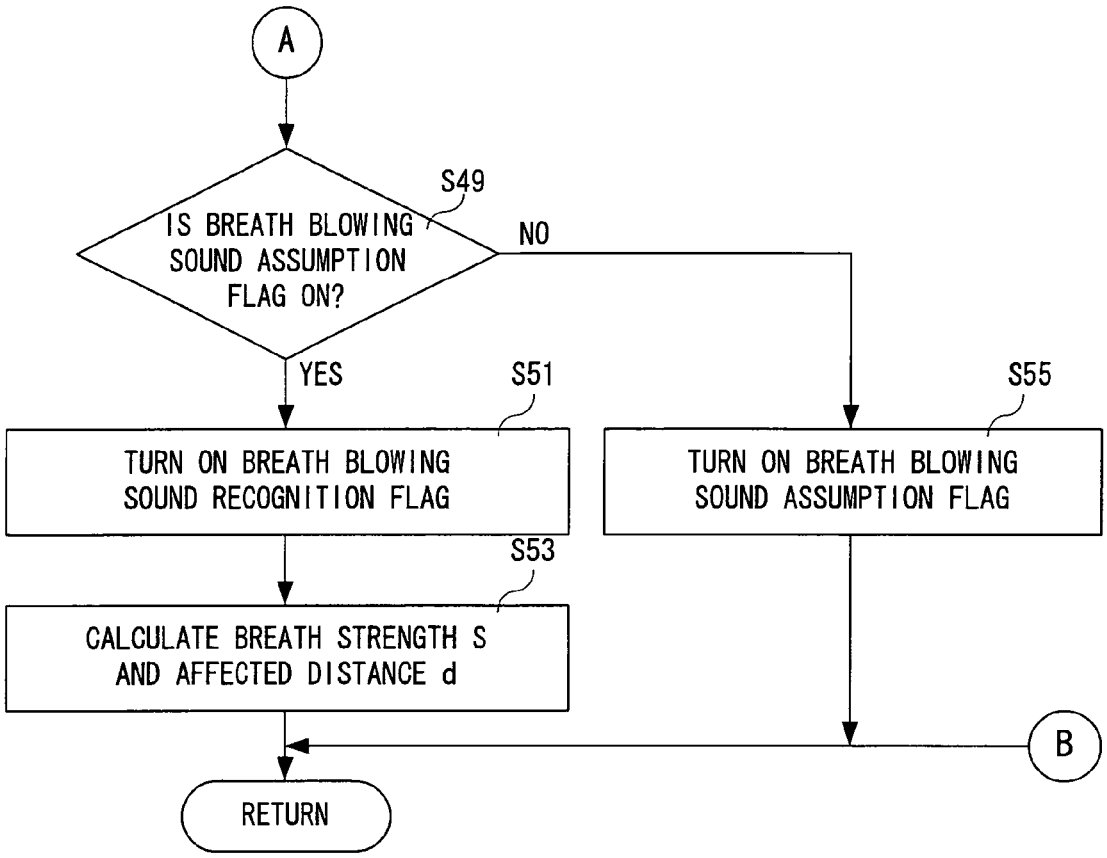
FIG. 10 is a flowchart showing another part of the breath blowing determining process continued from FIG. 9.

FIG. 9 and FIG. 10 are flowcharts indicative of the breath blowing determining process of step S13 shown in FIG. 8. As shown in FIG. 9, when starting the breath blowing sound determining process, the CPU core 42 performs a sound detection process in a step S31. More specifically, the CPU core 42 stores sound data corresponding to a sound input through the microphone 34 in the data storage area 482. Incidentally, in the case where the sound detection process is performed, a noise gate process is carried out as well. To be more specific, sound data of a certain level or lower is regarded as mere noise and excluded (rejected) from the input sound data. In a succeeding step S33, the number of times when the sound wave crosses the part with an amplitude of zero in the course of changing from minus to plus levels (the number of zero crossings) is counted in the buffer (the buffer area of the RAM 48), and a value obtained by multiplying by 8 the number of times (the number of zero crossings) for the most recent eight frames is saved as f (the numerical value f). That is, the numerical value f is determined by reference to the input sound data 482*d*.

Figure 5:
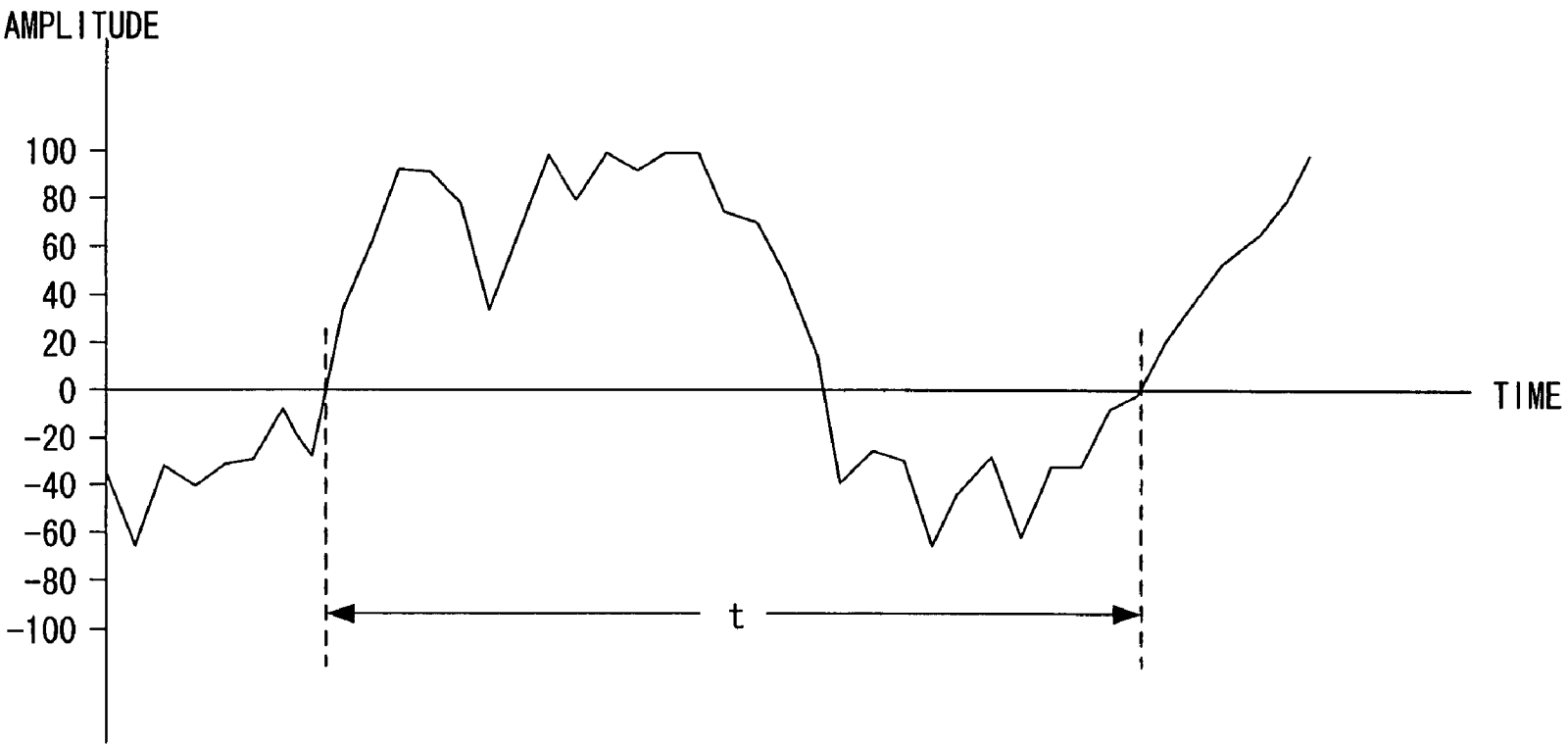
FIG. 5 is a graph with an enlarged part of the sound waveform shown in FIG. 4.

Subsequently, in a step S35, it is determined whether or not the variable f falls within a range of 98 to 1883 ($98 \leqq f \leqq 1883$). Here, it is simply determined whether the input sound is a breath sound or not. This is because, if a breath (wind) assumed to be used in a game is actually blown on the microphone 34, the numerical value f will be approximately within that range ($98 \leqq f \leqq 1883$). This is also because the breath strength S is to be set between 1 and 255. If "NO" in the step S35, that is, if the numerical value f is 97 or less or 1884 or more, the process goes directly to a step S45. On the other hand, if "YES" in the step S35, that is, if the numerical value f is between 98 and 1883, individual interval times t between the crossings contained in one frame of sound waveform are measured in a step S37. Here, as described in relation to FIG. 5, the individual interval times t between zero crossings in changing from minus to plus levels are measured.

In a succeeding step S39, the distributions of the interval times t are detected. That is, the measured interval times t are classified under groups. More specifically, in accordance with the lengths of times set for group A to group D, the numbers of the interval times t which were measured in the step S37, belonging to the groups, are counted. Accordingly, count values ($x_A$, $x_B$, $x_C$ and $x_D$) are obtained. Next, in a step S41, the distribution detected in the step S39 is compared to the reference data 482*c*. That is, the area (number) is selected in accordance with the numerical value f, and it is determined whether or not the count values ($x_A$, $x_B$, $x_C$ and $x_D$) are within the respective set ranges of the group A to group D that are described in correspondence with the selected area, or whether or not the count values match the respective set values.

Subsequently, it is determined in a step S43 whether or not the distributions satisfy the requirements. More specifically, it is determined whether or not the results of determination in the step S41 fall within the respective set range of group A to group D, or the results match the respective set values. Here, if all the set ranges or all the set values are satisfied, it is concluded that the distributions satisfy the requirements (there is a match among the frequency distributions). If any of the set ranges or set values is not satisfied, it is concluded that the distributions do not satisfy the requirements (there is no match among the frequency distributions). If "YES" in the step S43, that is, if the distributions satisfy the requirements, it is assumed that the input sound is close to a breath blowing sound, and the process goes to a step S49 shown in FIG. 10. However, if "NO" in the step S43, that is, if the distributions do not satisfy the requirements, it is determined that the input sound is not a breath blowing sound, and the breath blowing sound assumption flag 482*f* is turned off in the step S45. Furthermore, the breath blowing sound recognition flag 482*f* is turned off in a step S47, and the breath blowing determining process is returned as shown in FIG. 10.

As described in FIG. 10, it is determined in a step S49 whether the breath blowing sound assumption flag 482*e* is on or not. That is, it is determined whether or not the input sound is assumed to be close to a breath blowing sound for two consecutive frames. If "YES" in the step S49, that is, if the breath blowing sound assumption flag 482*e* is on, it is determined that the input sound is a breath blowing sound, and the breath blowing sound recognition flag 482*f* is turned on in a step S51, and the breath strength S and the breath-reached distance d are calculated according to the equation 1 and the equation 2 in a step S53, and then the breath blowing determining process is returned. On the other hand, if "NO" in the step S49, that is, if the breath blowing sound assumption flag 482*e* is off, it is determined that the frames during which the input sound is assumed to be close to a breath blowing sound are not consecutive, the breath blowing sound assumption flag 482*e* is turned on in a step S55, and the breath blowing determining process is returned.

According to the first embodiment, when the distributions of interval times of zero crossings match the preset distributions and such a situation continues for a predetermined amount of time, it is concluded that the input sound is a breath blowing sound. This makes it possible to recognize a breath blowing operation with accuracy.

Also, in the first embodiment, memory capacity can be decreased just by storing in advance the table data such as reference data, as compared with the case of storing in advance various waveform patterns of sound elements.

Additionally, in the first embodiment, no complicated arithmetic operations are needed because it is just enough to examine the distributions of interval times of zero crossings, which makes it possible to reduce a processing load on the CPU core.

Moreover, it is possible to easily set (detect) the strength of a breath or wind by setting the breath or wind strength according to the number of zero crossings in the input sound waveform. Furthermore, different game processes (image processing) are carried out according to the breath or wind strength, which would make the game more interesting.

Besides, with regard to the first embodiment, the game apparatus equipped with two LCDs is described. Alternatively, the game apparatus may have only one LCD. In addition, the touch panel may be not provided to the game apparatus.

Second Embodiment

Figure 11:
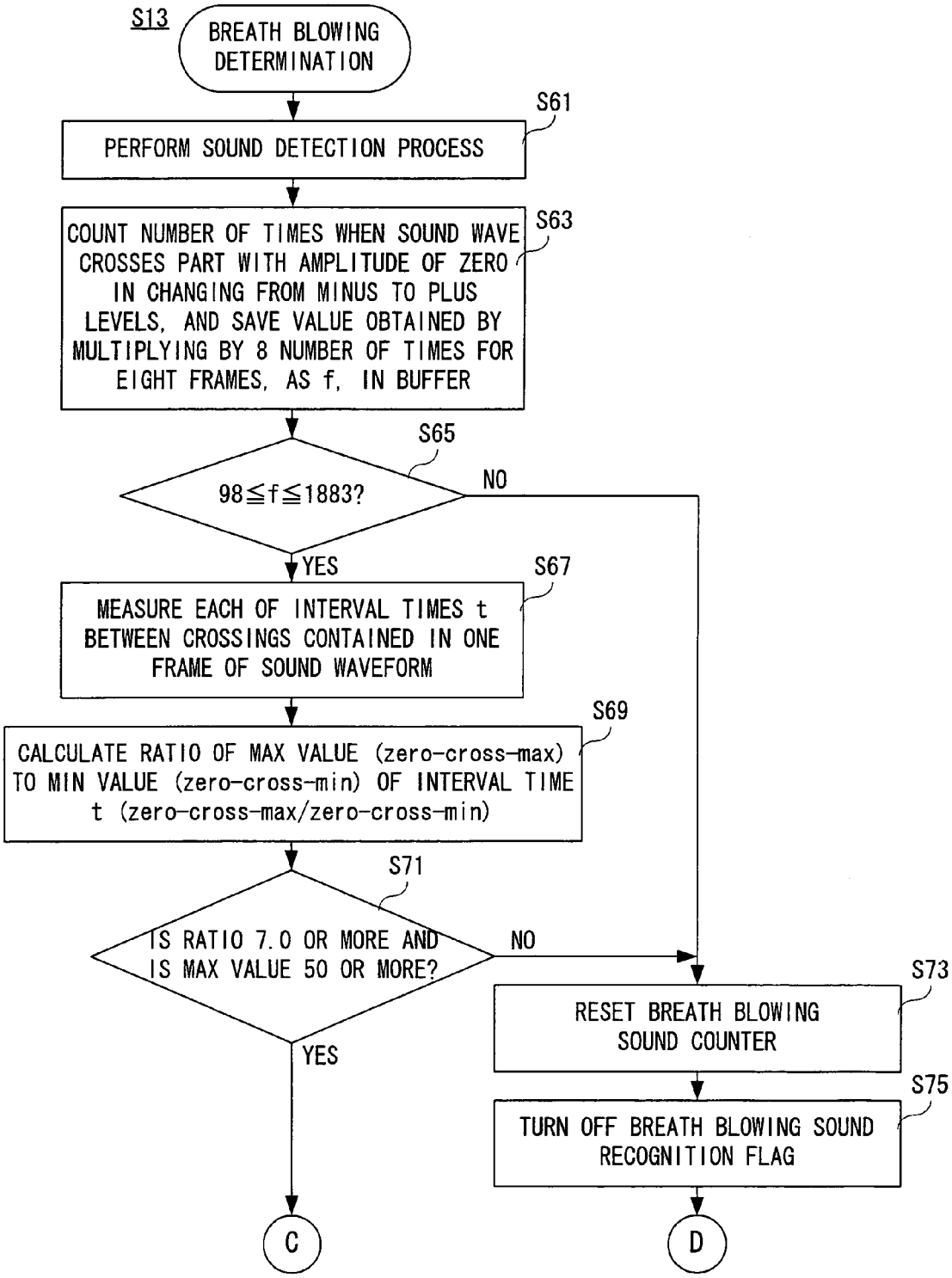
FIG. 11 is a flowchart showing a part of a breath blowing determining process of a second embodiment.
Figure 12:
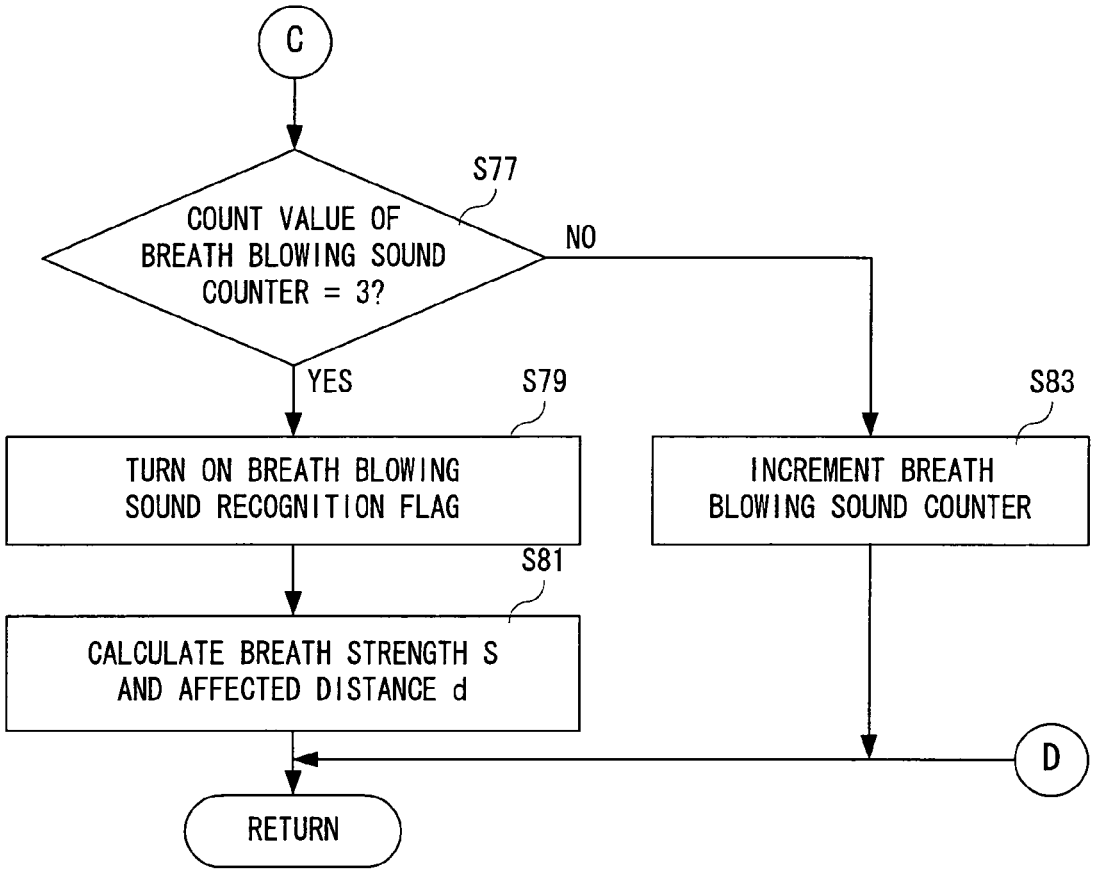
FIG. 12 is a flowchart showing another part of the breath blowing determining process continued from FIG. 11.

The game apparatus 10 of the second embodiment is identical to the game apparatus 10 of the first embodiment, with the exception that the breath blowing determining processes are not the same. Thus, a duplicated description is omitted below. In the second embodiment, it is determined (recognized) whether or not an input sound is a breath blowing sound based on the maximum value and minimum value of interval time t between zero crossings in the input sound waveform. Accordingly, the reference data 482*d* described in regard to the first embodiment is not required here, which leads to a reduction in the memory capacity. FIG. 11 and FIG. 12 show a flowchart for a specific breath blowing determining process. However, the same processes as those described in relation to the first embodiment are briefly explained here. In the breath blowing determining process of the second embodiment, an input sound is concluded to be a breath sound if the time during which the input sound is assumed to be close to a breath sound continues for three frames or more. Therefore, instead of the breath blowing sound assumption flag 482*e* shown in relation to the first embodiment, a counter (not illustrated) for counting the time during which an input sound is assumed to be close to a breath sound (the number of frames) is provided in the data storage area 482 of the RAM 482, for example.

Referring to FIG. 11, when starting the breath blowing determining process, the CPU core 42 performs the sound detection process in a step S61. As in the case of the first embodiment (S31), the noise gate process is carried out here. In a succeeding step S63, the number of times when the wave crosses the part with an amplitude of zero in the course of changing from minus to plus levels is counted in the buffer, and a value obtained by multiplying by 8 the number of times for the most recent eight frames is saved as numerical value f. Then, it is determined in a step S65 whether or not the numerical value f falls within a range of 98 to 1883. If "NO" in the step S65, the process moves directly to a step S73. On the other hand, if "YES" in the step S65, the individual interval times t between the crossings contained in one frame of sound waveform are measured in a step S67.

In a succeeding step S69, the ratio of the maximum value (zero-cross max) to the minimum value (zero-cross min) of interval time t is calculated (zero-cross max/zero-cross min). Then, it is determined in a step S71 whether or not the ratio calculated in the step S69 is a first predetermined value (7.0 here) or more and whether or not the maximum value is a second predetermined value (50 (1/80000 sec) here) or more. That is, it is determined whether or not the interval times t between the zero crossings satisfy the predetermined requirements. If "YES" in the step S71, that is, if the ratio is 7.0 or more and the maximum value is 50 (1/8000 sec) or more, the input sound is assumed to be close to a breath sound, and the process moves to a step S77 shown in FIG. 12. However, if "NO" in the step S71, that is, if the ratio is less than 7.0 and/or the maximum value is less than 50 (1/8000 sec), the input sound is concluded to be not a breath sound, and the breath blowing sound counter is reset (count value=0) in a step S73, the breath blowing sound recognition flag 482*f* is turned off in a step S75, and then the breath blowing determining process is returned as shown in FIG. 12. Incidentally, the first predetermined value and the second predetermined value are values obtained empirically from experiments, etc.

As shown in FIG. 12, it is determined in the step S77 whether the count value of the breath blowing sound counter is 3 or not. That is, it is determined whether or not the input sound is assumed to be close to a breath sound for three consecutive frames. If "YES" in the step S77, that is, if the count value of the breath blowing sound counter is 3 (or more), the input sound is determined to be a breath blowing sound, the breath blowing sound recognition flag 482*f* is turned on in a step S79, and the breath (wind) strength S and the affected distance d are calculated according to the equation 1 and the equation 2 in a step S81, and then the breath blowing determining process is returned. On the other hand, if "NO" in the step S77, that is, if the count value of the breath blowing sound counter is not 3 (less than 3), the breath blowing sound counter is incremented in a step S83, and the breath blowing determining process is returned.

In the second embodiment as well as in the case of the first embodiment, an input sound is determined as a breath sound if the number of zero crossings in the input sound waveform is within a certain range and the maximum value and minimum value of interval time between zero crossings satisfy predetermined requirements consecutively for a predetermined amount of time. This makes it possible to determine a breath blowing action with high accuracy.

In addition, since no reference data is required in the second embodiment, it is possible to further reduce memory capacity as compared to the case with the first embodiment.

Although the exemplary embodiment presented herein has been described and illustrated in detail, it is clearly understood that the same is by way of illustration and example only and is not to be taken by way of limitation, the spirit and scope of the exemplary embodiment being limited only by the terms of the appended claims.

What is claimed is:

1. A storage medium storing a breath blowing determining program for a breath blowing determining apparatus that is equipped with at least a microphone and determines whether or not a sound input from outside through said microphone is made by a breath, wherein said breath blowing determining program allows a processor of said breath blowing determining apparatus to perform:

input sound detecting for detecting a sound input from outside at each unit of time;

time measuring for measuring individual times between zero crossings in waveform data of the sound detected in said input sound detecting; and sound determining for determining whether or not said sound detected on the basis of the individual times measured in said time measuring is made by the operator's breath.

2. A storage medium storing a breath blowing determining program according to claim 1, wherein said sound determining includes frequency distribution detecting for detecting a frequency distribution of said waveform data based on the individual times measured in said time measuring, and frequency distribution determining for determining whether or not the frequency distribution detected in said frequency distribution detecting satisfies a preset requirement.

3. A storage medium storing a breath blowing determining program according to claim 2, wherein said frequency distribution detecting includes time length classifying for classifying lengths of said individual times into a plurality of groups, in said frequency distribution determining, it is determined whether or not the numbers of the time lengths classified into said plurality of groups fall within respective ranges preset for the groups, and when it is been determined in said frequency distribution determining that the numbers of the time lengths classified into said plurality of groups fall within the respective ranges preset for the groups, it is concluded in said sound determining that said detected sound is made by a breath.

4. A storage medium storing a breath blowing determining program according to claim 1, wherein said breath blowing determining program further allows ratio detecting to be performed for detecting the ratio of maximum value to minimum value of time lengths of said individual times, and in said sound determining, if the ratio detected in said ratio detecting is equal to or more than a first predetermined value and said maximum value is equal to or more than a second predetermined value, said input sound is concluded to be made by a breath.

5. A breath blowing determining apparatus that is equipped with at least a microphone and determines whether or not a sound input from outside through said microphone is made by a breath, comprising:

input sound detecting circuitry for detecting a sound input from outside at each unit of time;

time measuring programmed logic circuitry for measuring individual times between zero crossings in waveform data of the sound detected in said input sound detecting step; and sound determining programmed logic circuitry for determining whether or not said sound detected on the basis of the individual times measured in said time measuring step is made by the operator's breath.

6. A breath blowing determining method for a breath blowing determining apparatus that is equipped with at least a microphone and determines whether or not a sound input from outside through said microphone is made by a breath, including:

(a) detecting a sound input from outside at each unit of time;

(b) measuring individual times between zero crossings in waveform data of the sound detected in (a); and (c) determining whether or not said sound detected on the basis of the individual times measured in (b) is made by the operator's breath.

7. A storage medium storing a game program for a game apparatus that carries out a game process based on a sound input from outside, wherein said game program allows a processor of said game apparatus to perform:

input sound detecting for detecting a sound input from outside at each unit of time;

time measuring for measuring individual times between zero crossings in waveform data of the sound detected in said input sound detecting;

sound determining for determining whether or not said sound detected on the basis of the times measured in said time measuring is made by the operator's breath; and game processing, when it is determined in said sound determining that the input sound is made by the breath, for carrying out a game process in accordance with the breath.

8. A storage medium storing a game program according to claim 7, wherein said sound determining includes frequency distribution detecting for detecting a frequency distribution of said waveform data based on the individual times measured in said time measuring, and frequency distribution determining for determining whether or not the frequency distribution detected in said frequency distribution detecting satisfies a preset requirement.

9. A storage medium storing a game program according to claim 8, wherein said frequency distribution detecting includes time length classifying for classifying lengths of the individual times measured in said time measuring into a plurality of groups, in said frequency distribution determining, it is determined whether or not the numbers of the time lengths classified into said plurality of groups fall within respective ranges preset for the groups, and when it is determined in said frequency distribution determining that the numbers of the time lengths classified into said plurality of groups fall within the respective ranges preset for the groups, it is concluded in said sound determining that said detected sound is made by a breath.

10. A storage medium storing a game program according to claim 9, wherein said game program further allows continuation state determining to be performed for determining whether or not a state in which the numbers of the time strengths fall within the preset ranges for all the groups continues for a predetermined period of time or more, and when it is determined in said continuation state determining that the state has continued for the predetermined period of time or more, it is concluded in said sound determining that said detected sound is made by the operator's breath.

11. A storage medium storing a game program according to claim 7, wherein said game program further allows number-of-zero crossing counting to be performed for counting the number of said zero crossings, and when it is determined that the number of said zero crossings falls within a preset range, it is concluded in said sound determining that said detected sound is made by the operator's breath.

12. A storage medium storing a game program according to claim 11, wherein said game program further allows strength setting to be performed for setting the strength of a breath based on the number of the zero crossings counted in said number-of-zero crossing counting, and in the game processing, a game process is performed according to the breath strength set in said strength setting.

13. A storage medium storing a game program according to claim 12, wherein in the game processing, a game process is carried out in such a manner as to make a change to the range affected by a breath or wind in the game space, according to the breath strength set in said strength setting.

14. A storage medium storing a game program according to claim 7, wherein in said game processing, a game process is carried out in such a manner that a character of the game performs the action of blowing a breath.

15. A storage medium storing a game program according to claim 7, wherein said zero crossing is a boundary point at which the amplitude value of said waveform data changes from minus to plus levels or from plus to minus levels.

16. A storage medium storing a game program according to claim 7, wherein said game program further allows ratio detecting to be performed for detecting the ratio of maximum value to minimum value of time length of said individual times, and when the ratio detected in said ratio detecting is equal to or more than a first predetermined value and said maximum value is equal to or more than a second predetermined value, in said sound determining, said input sound is concluded to be made by said operator's breath.

17. A game apparatus performing a game process based on a sound input from outside, comprising:

input sound detecting circuitry for detecting a sound input from outside at each unit of time;

time measuring programmed logic circuitry for measuring individual times between zero crossings in waveform data of the sound detected in said input sound detecting;

sound determining programmed logic circuitry for determining whether or not said sound detected on the basis of the individual times measured in said time measuring is made by the operator's breath; and game processing programmed logic circuitry for, when it is determined in said sound determining that the input sound is made by the breath, carrying out a game process in accordance with the breath.

18. A game control method for carrying out a game process based on a sound from outside, including:

(a) detecting a sound input from outside at each unit of time;

(b) measuring individual times between zero crossings in waveform data of the sound detected in (a);

(c) determining whether or not said sound detected on the basis of the times measured in (b) is made by the operator's breath; and (d) when it is determined in (c) that the detected sound is made by the breath, carrying out a game process based on the breath.

* * * * *